United States Patent [19]

Ferguson

[11] Patent Number: 4,841,760

[45] Date of Patent: Jun. 27, 1989

[54] PROCESS AND APPARATUS FOR MANUFACTURING TUBE BENDS

[76] Inventor: James M. Ferguson, Beresford House, 5/6 Claremont Terrace, Glasgow G3 7XR, Scotland

[21] Appl. No.: 191,167

[22] PCT Filed: Aug. 13, 1987

[86] PCT No.: PCT/GB87/00571

§ 371 Date: Apr. 7, 1988

§ 102(e) Date: Apr. 7, 1988

[87] PCT Pub. No.: WO88/01207

PCT Pub. Date: Feb. 25, 1988

[30] Foreign Application Priority Data

Aug. 13, 1986 [GB] United Kingdom ..... 8619759

[51] Int. Cl.[4] ..... B21D 9/12

[52] U.S. Cl. ..... 72/133; 72/369

[58] Field of Search ..... 29/157 A; 72/133, 369, 72/168

[56] References Cited

U.S. PATENT DOCUMENTS 1,951,802 3/1934 Loepsinger .

2,441,299 3/1948 Taylor .

FOREIGN PATENT DOCUMENTS 2517891 11/1976 Fed. Rep. of Germany .

*Primary Examiner*—Lowell A. Larson

*Attorney, Agent, or Firm*—Larson and Taylor

[57] ABSTRACT

A process for making a tube bend of a predetermined wall thickness from a length of straight tube comprises forming the straight tube to have a quasi-elliptical cross section and irregular wall thickness which has a maximum value on one side of the major axis of the quasi ellipse, expanding the quasi-elliptical tube to cause the wall thickness on the other side of the major axis to be reduced and bending the tube about an axis located on said other side of said major axis. Apparatus suitable for performing the process comprises a die (2) formed with an oblique inclined converging passage (3) of circular cross section at one end changing progressively to quasi-elliptical cross section at the other end and a curved mandrel (6) having a portion (8) which changes from quasi-elliptical cross section at the shank (7) to circular cross section at the curved portion (9).

10 Claims, 1 Drawing Sheet

PROCESS AND APPARATUS FOR MANUFACTURING TUBE BENDS

This invention relates to the manufacture of metallic tube bends from straight lengths of tube and particularly to the manufacture of tube bends of the type referred to in the trade as short radius bends i.e. bends the mean radius of curvature of which is short with respect to the diameter of the tube, for example those in which the mean radius of curvature of the bend is equal to 1½times the nominal diameter of the tube.

In this specification the word tube is to be understood as including tubes and pipes.

The expressions "nominal wall thickness" and "nominal diameter" are used in the tube manufacturing industry and in the specification to mean the wall thickness and diameter by which a tube is identified. Tubes sold as of specified nominal dimensions may be of actual dimensions which differ from the nominal dimensions by maximum stated amounts known as the manufacturing tolerances.

In short radius bends such as those referred to there is such a large difference between the length of the bend at the inside of the bend and the length of the bend at the outside of the bend that simply bending a length of straight tube to the required radius does not provide an acceptable bend. A straight tube being bent in the usual manner by being bent around a curved former normally bends about its neutral axis. Thus the material at the inside of the bend is compressed longitudinally so much that it becomes too thick and often wrinkles as well while the material at the outside of the bend is stretched longitudinally so much that it becomes too thin.

Processes for the production of tube bends of such short radius and more or less constant wall thickness or other desired proportions of wall thickness are already well known.

An early known process consists of forcing at red heat a tube of smaller nominal bore than the required nominal bore of the finished bend required over a curved eccentrically expanding mandrel of circular cross section the final diameter of which is equal to the nominal bore of the bend to be made. This process is the subject of U.S. Pat. No. 1,353,714.

Tubes and tube bends are normally made to standardized dimensions and the known process and other later processes based on that early process suffer from the disadvantage that to produce bends of almost all of these standardized dimensions the smaller diameter straight tubes required must have diameters and wall thicknesses which are not standardized dimensions. Also the large amount of expansion which is performed on the tube precludes performance of the process cold because in this process the percentage expansion required exceeds the elongation that tube materials such as steel can bear in the cold state. Thus the process must be performed at forging temperature i.e. at a red heat. Also many of these known processes require separate and distinct operations to be performed on the tube so that tube bends cannot be produced consecutively as a continuous operation.

A method of and apparatus for producing tube bends from straight tube of the same diameter and wall thickness, thus obviating the need for non-standard tubes and employing a smaller percentage expansion is described in the specification of my prior GB Pat. No. 775 000, (corresponding U.S. Pat. No. 2,976,908).

In the process of GB Pat. No. 775,000 the tube section is first subjected to an inwardly radially directed compressing force which varies around the circumference of the outer surface of the tube from a maximum value at one point on the circumference to a minimum value at a point diametrally opposite and the tube, now of reduced diameter, is then subjected to an outwardly radially directed expanding force which varies around the circumference of the inner surface of the tube from a maximum at the point where the previously applied inwardly directed compressing force was a minimum to a minimum value at the point diametrally opposite where the previously applied inwardly directed compressing force was a maximum so that the original diametral dimensions are restored and subsequently or simultaneously with the expanding action bending the tube about an axis which is normal, i.e. perpendicular to a diametral plane of the tube passing through the diametrally opposite points where the compressing force and the expanding force were a maximum and is on the side of the tube where the expanding force was a maximum. The process as described above is the preferred embodiment of the process but the compressing and expanding actions may be performed in the reverse order.

This process requires only half the percentage expansion of the process described using a tube initially of smaller diameter. However the process of GB Pat. No. 775,000 suffers from other disadvantages which preclude this process also from being performed cold. The reason is explained below.

During the compressing operation substantially all parts of the tube wall around the circumference are compressed and made thicker than they were originally including the wall of the half of the tube which will form the inner half of the bend, i.e. the half adjacent the bending axis which subsequently requires to be circumferentially expanded and made thinner than it was originally so that it will increase in wall thickness back to the original wall thickness during the longitudinal compression it will experience during the bending operation. The strain energy required to compress and then expand this same half portion of the tube back to the original thickness is redundant energy. The wall thickness of the other half of the tube which will form the outside half of the bend is increased substantially all over in the compressing action so that the tube wall up to the ends of said outer half is thicker than the original wall thickness. This amount of increase of wall thickness must be reduced so that the particular amount of longitudinal stretching performed during the bending action on said half of the tube will produce the desired wall thickness. The strain energy required to provide the excess thickening and then to remove it is also redundant strain energy. Finally, in reducing the diameter of the tube during the circumferential compressing operation the tube wall is bent to a smaller radius and then in restoring the tube to its original diameter the tube wall is bent back to its original radius and the strain energy required to perform these bending operations is also redundant strain energy. All the redundant strain energy is imparted to the tube by way of thrust on one end of the tube which may be regarded as redundant end thrust. The total end thrust on the tube in the process of GB Pat. No. 775,000 is then the end thrust required to impart the necessary strain energy required only to redistribute the metal of the tube and bend the tube to provide the desired wall thickness plus the redundant strain energy. Because of the large amount of redundant strain energy and thus redundant end thrust required this process for a material such as steel cannot be performed cold because the total strain energy (necessary + redundant) which must be imparted to the tube is so high that in the cold state the end thrust on the tube necessary to generate that amount of strain energy is beyond the column strength of the tube so that any attempt to perform the process cold would result in collapse of the tube, also the amount of cold working to which the tube material would be subjected would be excessive and would have a damaging effect on the strength of the finished bend.

There are many disadvantages associated with performing the process as a hot process. For example, the speed of production is limited by the rate at which heat can be fed to the tube, finished bends of ferrous material are heavily coated with scale and usually require subsequent heat treatment and final shaping in a die, the heat energy required is considerable and adds appreciably to manufacturing costs, expensive heat-resisting materials must be used for the tools and a long period of preliminary heating up is required when starting the process. Also working conditions at the machine are unpleasant. Nevertheless despite these disadvantages short radius tube bends have been made hot for many years because heretofore no satisfactory continuous process has been available for making short radius tube bends cold.

To make possible the cold manufacture of such short radius bends as a continuous operation it is necessary to reduce the end thrust on the tube being bent to a value within the column strength of the tube. This is done in the process of the present invention by eliminating or reducing to an insignificant figure the redundant strain energy of the previously known process.

Thus it is an object of the present invention to provide a tube bending process which can be performed cold on all the usual metallic materials, usually steel, of which tubes are made, and to provide apparatus for performing the process.

It is also an object of the present invention to provide a process and apparatus for producing tube bends of a given tube diameter and wall thickness from straight tube which may be of the same tube diameter and wall thickness without the application of heat.

Although the process of the invention is intended primarily as a cold process it can of course be performed if necessary at an elevated temperature, for example to produce bends in particularly brittle material while still retaining the advantage of using standard tube and requiring the minimum amount of end thrust and working of the tube metal in performance of the process.

A process for making a tube bend according to the invention comprises forming a straight tube of quasi-elliptical cross section in which a portion of tube wall has a non-constant thickness which is a maximum at the point where the minor axis of the quasi ellipse meets the tube wall on one side of the major axis of the quasi ellipse and which reduces progressively on each side of said point to a reduced thickness in the vicinity of the two points where said major axis meets the tube wall, applying against the portion of the inner surface of the tube wall on the other side of said major axis a radially directed expansion force of a magnitude sufficient to displace that portion of the tube wall away from said major axis to a position in which the tube has the required internal dimensions and shape of cross section of the bend to be formed and bending the tube about an axis parallel with and spaced from said major axis and lying on said other side of said major axis.

For forming a tube bend of substantially constant wall thickness around the entire circumference of the cross section of the tube bend the maximum thickness of the tube of quasi-elliptical cross section at the point where the minor axis of the quasi ellipse meets the tube wall on said one side of the major axis of the quasi ellipse is arranged to be in a ratio to the wall thickness of the bend to be formed which is substantially equal to the ratio of the mean length of the wall of the bend to be formed at the outside of the bend to the length of the bend along the centre line of the bend.

The portion of the tube wall of the quasi-elliptical tube on said other side of said major axis is preferably of a thickness substantially equal to the required wall thickness of the bend to be formed.

For special purposes, for example, to make a tube bend of special cross-sectional shape or to make a tube bend of specific diameter and thickness of the tube wall from a tube of different diameter and different thickness of tube wall the tube wall on said other side of said major axis may also be arranged to have a thickness which is a maximum at the point where the minor axis of the quasi-ellipse meets the tube wall on said other side of said major axis and reduces progressively in thickness on each side of said point to said reduced thickness in the vicinity of the points where the major axis of the quasi ellipse meets the tube, and a radially outwardly directed expansion force is also applied against the portion of the inner wall of the tube on said other side of said major axis. The two maximum thickness dimensions of the tube wall on opposite sides of the major axis may be different from one another.

A quasi-elliptical tube is preferably formed to have the greater part of the sections of wall on opposite sides of said major axis curved to substantially the same dimensions and shape of curvature as the tube wall of the bend to be formed.

The expansion force or forces applied against the inner tube wall Will normally be arranged to provide a tube bend of circular cross section, but other cross sections may be formed, e.g. an elliptical or an oval cross section may be formed.

The tube of quasi-elliptical cross section with the tube wall on one side of the major axis having a point of maximum thickness may be formed to such contour ab initio during manufacture of the tube or may be formed from a circular tube of constant wall thickness which is compressed asymmetrically by application of a graded force having radial and longitudinal components to the portion of the tube wall on one side of a diametral plane of the tube so that that portion of the tube wall is displaced towards said diametral plane and the tube assumes the required quasi-elliptical shape of which the major axis coincides with or is parallel with the said diametral plane of the original circular tube. By this action said portion of the tube wall is compressed circumferentially and thickened by an amount which is a maximum at the centre where the minor axis of the quasi ellipse meets the tube wall and reduces progressively on each side of the point of maximum thickness to a reduced thickness in the vicinity of the points where the major axis meets the tube wall.

The expression "quasi-elliptical cross section" is used in this specification to mean a cross section which closely resembles an ellipse in shape although it may not satisfy strictly the mathematical definition of an ellipse.

The quasi-elliptical shape referred to in the specification is preferably formed by two arcuate portions each having substantially the same radius as the original tube connected at their ends by short curved portions of relatively short radius.

The tube of quasi-elliptical cross section may be formed by supporting the portion of the outside surface of a straight tube of circular cross section on one side of a diametral plane of the tube against transverse movement and applying to the outside surface of the portion of the tube wall on the other side of said diametral plane a force of sufficient magnitude and so directed and distributed as to displace said portion of the tube wall towards said diametral plane whereby to cause the tube to assume a quasi-elliptical cross section with the displaced wall having a thickness which has a maximum value, greater than the original thickness, at the centre point of said portion where the minor axis of the quasi-ellipse meets the displaced tube wall and reduces progressively on each side of said point to a reduced value substantially equal to the original thickness of the tube wall in the vicinity of the points where the major axis of the quasi ellipse meets the tube.

Alternatively the tube of quasi-elliptical cross section may be formed ab initio e.g. by an extrusion process from a solid or a hollow billet.

The circumferential stretching action may be performed by supporting the inside surface of the portion of the tube wall on said one side of said major axis against transverse movement and applying to the inside surface of the portion of the tube wall on said other side of said major axis a force sufficient to displace said portion of the tube wall in the direction away from said major axis, said force being so distributed that the displacement of the tube wall is greatest at the centre of said portion of the tube wall and reduces in magnitude progressively to a reduced value in the vicinity of the ends of said portion.

It is sometimes required that a tube bend should have a non-constant wall thickness around its circumference. In such a case it may be required that the wall thickness should have a minimum dimension at the inside of the bend and a maximum dimension at the outside of the bend, the thickness at intermediate positions having intermediate values. To produce a bend of such a form the two ratios viz. longitudinal compression:circumferential stretching (over the inside half of the bend) and longitudinal stretching:circumferential compression (over the outside half of the bend) may be kept equal to one another but different from the ratio of the mean radius of bending of the tube wall at the outside of the bend:mean radius of bending at the centre line of the bend. If said two ratios of compressing and stretching are less than said ratio of the mean radius of bending of the outer wall to the centre line the bend will have a wall which is thinner at the inside of the bend than it is at the outside. If said two ratios of compressing and stretching are greater than said ratio of mean radius of bending of the outer wall to the centre line the bend will have a wall which is thicker at the inside that it is at the outside. Thus, to form such a tube bend having a non-constant wall thickness, the tube is first formed to a quasi-elliptical cross section having a maximum thickness on one side of the major axis of the quasi ellipse greater or less than the thickness required to form a bend of constant wall thickness depending on whether the wall thickness at the outside of the bend is to be greater or less than the wall thickness at the inside of the bend.

For most purposes the straight length of tube which is to be used to form a bend has the same nominal diameter and wall thickness as the bend to be formed. Nevertheless for special effects, e.g. to produce an unusual variation of wall thickness around the circumference of the tube of the bend or for expediency e.g. if tube of the desired diameter is not immediately available, a bend of a given nominal diameter and wall thickness or an acceptable approximation thereto may be produced from straight tube of a different nominal diameter and/or wall thickness by choosing appropriate values of circumferential stretching and compression.

In a tube not formed ab initio to a quasi-elliptical shape the actions of compressing circumferentially and stretching longitudinally the portion of the tube to be subjected to these particular operations and of stretching circumferentially and compressing longitudinally the other portion of the tube to be subjected to these other particular operations may be performed consecutively in any desired order. For harder materials such as steel it will normally be desirable to perform the action of compressing as an operation separate from the actions of stretching and bending. This ensures that the end thrust on the tube is well within the column strength of the tube. In some circumstances certain of these actions may be performed simultaneously. For example it may be found convenient to compress circumferentially said one portion of the tube first and then subsequently stretch longitudinally said one portion and stretch circumferentially and compress longitudinally said other portion of the tube simultaneously. Alternatively, the actions of compressing circumferentially said one portion of the tube and expanding circumferentially said other portion of the tube may be performed simultaneously first and the actions of stretching longitudinally said one portion of the tube and compressing longitudinally said other portion of the tube may be performed simultaneously and subsequently.

The force required to provide the energy for compressing, expanding and bending the tube may be generated by an end thrust against the tube generating a longitudinal compressive stress in the tube which is arranged to have radial and axial components providing the radial compressing, expanding and bending forces or may be generated by a pulling action generating a longitudinal tensile stress in the tube arranged to have radial and axial components providing the radial compressing expanding and bending forces, or may be generated by a combined thrust against an end of the tube and a pulling action on another part of the tube.

One form of apparatus for performing the process incorporates a die formed with an oblique passage which changes gradually from one end to the other from a circular cross section the diameter of which is large enough for entry of one end of the tube to be bent to a cross section of quasi-elliptical shape the major axis of which is offset from the axis of the circular end, the length, the width and the amount of offset of the end of quasi-elliptical shape having the dimensions required to provide the amount of distribution of the circumferential compression required for performance of the process, the tube stretching and bending means including a mandrel having an oblique stretching portion which changes gradually from one end to the other from a quasi-elliptical cross section of dimensions to fit within the interior contour of a tube compressed in the die to a circular cross section the centre of which lies on one side of the major axis of the quasi-elliptical end and the diameter of which is substantially equal to the nominal bore of the bend to be formed, and a tube bending portion curved to substantially the same mean radius as that of the bend to be formed, the centre of curvature of said tube bending portion lying on the same side of the major axis of the quasi-elliptical end of the tube bending portion as the centre of the end of circular cross section and the die and the mandrel being so orientated that the oblique passage in the die and the oblique stretching portion of the mandrel are inclined in the same general direction.

An example of apparatus for performing the invention is illustrated in the accompanying diagrammatic drawings in which.

Figure 1:
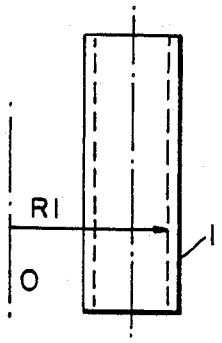
FIG. 1 illustrates a straight length of tube to be formed into a bend.
Figure 2:
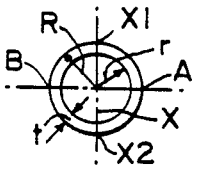
FIG. 2 is a view looking on an end of the length of the tube of FIG. 2.
Figure 4:
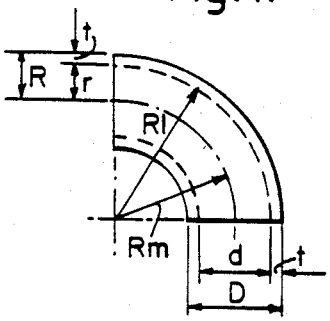
Figure 3:
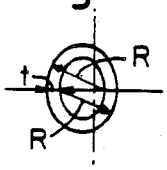
Figure 5:
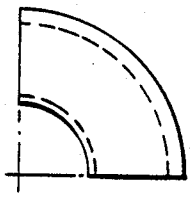
Figure 6:
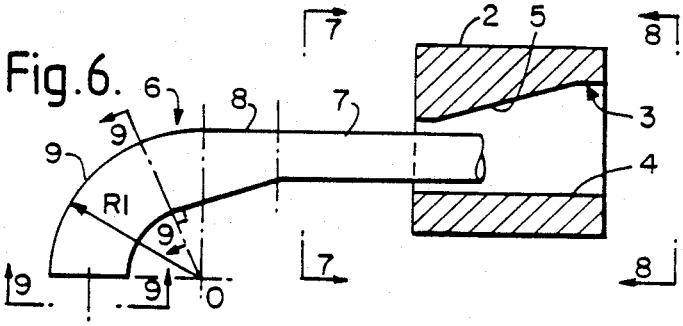
Figure 7:
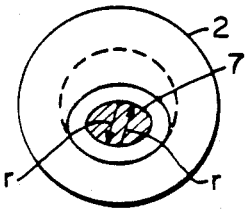
Figure 8:
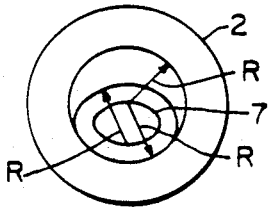
Figure 9:
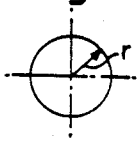

FIG. 3 is a cross section of the tube after the circumferential compressing operation, FIG. 4 shows a tube bend having a constant wall thickness all around the circumference, FIG. 5 shows a tube bend the wall of which is thicker at the outside of the bend than it is at the inside of the bend, FIG. 6 shows one embodiment of apparatus for performing the process of the invention, FIG. 7 is a view through the line 7—7 in FIG. 6, FIG. 8 is a section at the position 8—8 in FIG. 6, and FIG. 9 is a section at the positions 9—9 in FIG. 6.

In the drawings R and r denote respectively the radius of the outside and of the inside of the tube 1. R1 denotes the radius to which the tube is bent measured from an axis of bending 0 to the inner wall of the tube at the outside of the bend (see FIG. 4). X denotes the diametral plane intersecting the walls of the tube 1 at X1 and X2. In forming a bend about the axis 0 the arc X1,A,X2 of the tube 1 lying on the outside, i.e. the farther side, of the plane X with respect to the axis of bending 0 will be subjected to the circumferential compressing and the longitudinal stretching operations and the arc X1,B,X2 of the tube 1 lying on the other side, i.e. the inside, of the plane X with respect to the axis of bending 0 will be subjected to the circumferential stretching and the longitudinal compressing operations. Rm denotes the mean radius of curvature of the bend.

Referring particularly to FIGS. 6 to 9, 2 denotes a die formed with an oblique converging passage 3 which is circular in cross section at one end with a diameter large enough to allow the tube length 1 to enter it and which tapers obliquely to a quasi-elliptical cross section at the other end (see FIGS. 7 and 8) while maintaining the large radius of the quasi-elliptical cross section substantially equal to R. The side 4 of the passage 3 which is arranged to receive the arc X1,B,X2 of the tube length 1 entering the passage 3 remains parallel to the plane X of the tube length 1 and the side 5 of the passage 3 which receives the arc X1,A,X2 of the tube length 1 is inclined obliquely to the plane X and serves to compress circumferentially the arc X1,A,X2, of the tube length 1 as the tube length 1 is forced through the die 2. 6 denotes a mandrel having a straight shank 7, a straight stretching portion 8 which over most of its length is of quasi-elliptical section (see FIG. 7) to receive and stretch to the opposite side of the major axis the quasi-elliptical tube length (FIG. 3)and a bending portion 9 the cross-sectional diameter of which is such as to provide a bend of the desired bore. The bending portion 9 may be curved to a radius which at the outside is the radius R1 (FIG. 4) or slightly less than R1 if it is found necessary to allow for spring back of the bent tube when the bent tube leaves the head. The cross section of the portion 8 changes from a quasi-elliptical cross section to a circular cross section where it merges with the bending portion 9 (see FIG. 9). The major radii of the quasi-elliptical portion of the head remain however both substantially equal to r during the whole operation. In certain circumstances a slightly non-circular shape for the portion 9 of the mandrel may be found desirable to allow for differential spring back in the tube material when the tube leaves the mandrel. Likewise the radius of the circular end of the mandrel may be given a radius different by a slight amount from r, usually bigger if the tube shows a tendency to contract in diameter when it leaves the mandrel.

In practice, a straight length of tube such as that denoted by 1 is introduced into the circular end of the die 2 and pushed through the die. When it leaves the quasi-elliptical end of the die it has the cross section illustrated in FIG. 3. In the die the portion of the tube in contact with the portion 5 of the die 2 is subjected to circumferential compression while the portion of the tube in contact with the portion 4 of the die 2 remains substantially as it was before it entered the die. The tube leaving the quasi-elliptical end of the die has the cross section illustrated in FIG. 3, i.e. substantially only the portion on one side of the plane X is compressed. Thus no redundant compression is performed on it. The quasi-elliptical section tube is now pushed over the straight stretching portion 8 so that substantially only the portion on the other side of the plane X is stretched. Thus no redundant stretching is performed on it. The tube is now moved on to and over the bending portion 9 of the madrel. As the tube moves over the bending portion 9 it bends about the axis of the bend to be formed. As bending takes place about the neutral axis of the tube the circumferentially compressed portion of the tube on the outside of the bend is stretched longitudinally and thus reduced in thickness to the predetermined extent while the circumferentially stretched portion of the tube at the inside of the bend is compressed longitudinally and thickened to the predetermined extent. The finished bend can thus be arranged to have a constant wall thickness as illustrated in FIG. 4. As the circumferential curvature of the tube wall remains substantially constant during the operations of compressing and stretching there is little or no redundant transverse bending performed on the tube wall.

The dimensions of the die and the mandrel can be chosen to provide a bend of any desired non-uniform wall thickness and of any desired ratio of bending radius to nominal bore of tube.

Apart from the greater convenience of operating a cold process there is no heating up time, several hours for large bends in the known hot process because the mandrel must be at red heat before a tube can be forced over it otherwise the tube tends to seize on it and often crumples; there are no hot parts which must be allowed to cool often requiring several hours before they can be removed readily to make a different size of bend; the mandrel and the die do not require to be of expensive, difficult-to-machine heat-resisting steel; the speed of operation is not limited by the time required to heat to red heat a cold tube being fed into the machine; since the cold material is work hardened to only a moderate extent in the process of the invention the finished bends leave the machine stronger than hot-produced bends and often have a strength equivalent to normalized bends. Also the cold bends are free from the dirt and scale which are always present on bends made hot. Lubricants capable of withstanding temperatures exceeding 800° C. are not required.

I claim:

1. A process for making a tube bend by forcing a straight tube over a curved expanding mandrel is characterized by forming a straight tube of quasi-elliptical cross section with the portion of the tube wall on one side of the major axis of the quasi-elliptical cross section of non-constant thickness which is a maximum at the point where the minor axis of the quasi ellipse meets the tube wall on one side of the major axis of the quasi ellipse and which reduces progressively on each side of said point to a reduced thickness in the vicinity of the two points where said major axis meets the tube wall, applying against the portion of the inner surface of the tube wall on the other side of said major axis a radially directed expansion force of a magnitude sufficient to displace that portion of the tube wall away from said major axis to a position in which the tube has the required internal dimensions and shape of cross section of the bend to be formed and bending the tube about an axis parallel with and spaced from said major axis and lying on said other side of said major axis.

2. A process for forming a tube bend according to claim 1, said bend being of substantially constant wall thickness around the entire circumference, is characterized in that the maximum thickness of the tube of quasi-elliptical cross section at the point where the minor axis of the quasi-ellipse meets the tube wall on said one side of the major axis of the quasi ellipse is arranged to be in a ratio to the wall thickness of the bend to be formed with is substantially equal to the ratio of the mean length of the wall of the bend to be formed at the outside of the bend to the length of the bend along the centre line of the bend.

3. A process for forming a tube bend according to claim 1 characterized in that the portion of the tube wall of the quasi-elliptical tube on said other side of said major axis is of a thickness substantially equal to the required wall thickness of the bend to be formed.

4. A process for forming a tube bend according to claim 1 characterized in that the tube wall on said other side of said major axis is arranged to have a thickness which is a maximum at the point where the minor axis of the quasi ellipse meets the tube wall on said other side of said major axis and reduces progressively in thickness on each side of said point to said reduced thickness in the vicinity of the points where the major axis of the quasi ellipse meets the tube, and a radially outwardly directed expansion force is also applied against the portion of the inner wall of the tube on said other side of said major axis.

5. A process for forming a tube bend according to claim 1 characterized in that the quasi-elliptical shape comprises two arcuate portions each having substantially the same mean radius as the mean cross-sectional radius of the tube wall of the bend to be formed connected at their ends by short curved portions of relatively short radius.

6. A process for making a tube bend according to claim 1 characterized in that the tube of quasi-elliptical cross section with the tube wall on one side of the major axis having a point of maximum thickness is formed to such contour ab initio during manufacture of the tube.

7. A process for making a tube bend according to claim 1 characterized in that the tube of quasi-elliptical cross section with the tube wall on one side of the major axis having a point of maximum thickness is formed from a circular tube of constant wall thickness which is compressed asymmetrically by application of a graded force having radial and longitudinal components to the portion of the tube wall on one side of a diametral plane of the tube so that that portion of the tube wall is displaced towards said diametral plane and the tube assumes the required quasi-elliptical shape of which the major axis coincides with or is parallel with the said diametral plane of the original circular tube.

8. A process for making a tube bend according to claim 1 characterized in that the tube of quasi-elliptical cross section is formed by supporting the portion of the outside surface of a straight tube of circular cross section on one side of a diametral plane of the tube against transverse movement and applying to the outside surface of the portion of the tube wall on the other side of said diametral plane a force of sufficient magnitude and so directed and distributed as to displace said portion of the tube wall towards said diametral plane whereby to cause the tube to assume a quasi-elliptical cross section with the displaced wall having a thickness which has a maximum value, greater than the original thickness, at the centre point of said portion where the minor axis of the quasi-ellipse meets the displaced tube wall and reduces progressively on each side of said point to a reduced value substantially equal to the original thickness of the tube wall in the vicinity of the points where the major axis of the quasi ellipse meets the tube wall.

9. Apparatus for forming a tube bend from a tube of quasi-elliptical cross section and non-constant wall thickness by means of a curved expanding mandrel is characterized in that the curved expanding mandrel (6) is formed with an oblique tube stretching portion (8) which changes gradually from one end to the other from a quasi-elliptical cross section of dimensions to fit within the interior contour of the tube of quasi-elliptical cross section to a circular cross section the centre of which lies on one side of the major axis of the quasi-elliptical end and the diameter of which is substantially equal to the nominal bore of the bend to be formed, and a tube bending portion (9) curved to substantially the same mean radius as that of the bend to be formed.

10. Apparatus for forming a tube bend according to claim 9 characterized by incorporating means for forming a tube of quasi-elliptical cross section from a tube of circular cross section, said means comprising tube compressing means including a die (2) formed with an oblique passage (3) which changes gradually from one end to the other from a circular cross section the diameter of which is large enough for entry of one end of the tube (1) to be bent to a cross section of quasi-elliptical shape the major axis of which is offset from the axis of the circular end.

* * * * *